United States Patent [19]

Brian, Jr. et al.

[11] Patent Number: 4,950,132

[45] Date of Patent: Aug. 21, 1990

[54] SWASHPLATE AND SLIDING SHOE ASSEMBLY FOR AN AIR CONDITIONING COMPRESSOR

[75] Inventors: Chester J. Brian, Jr., Birmingham; Karen M. Menapace-Burmeister, Livonia, both of Mich.

[73] Assignee: Ford Motor Company, Dearborn, Mich.

[21] Appl. No.: 155,173

[22] Filed: Feb. 11, 1988

[51] Int. Cl.[5] ..... F04B 1/16; F04B 1/18

[52] U.S. Cl. ..... 417/269; 92/71

[58] Field of Search ..... 92/71; 417/269

[56] References Cited

U.S. PATENT DOCUMENTS

| | | | |
|---|---|---|---|
| 3,380,651 | 4/1968 | Niki et al. | 417/269 |
| 3,998,570 | 12/1976 | Jacobs | 417/274 |
| 4,030,405 | 6/1977 | Aldinger et al. | 92/72 X |
| 4,231,727 | 11/1980 | Buchholtz | 418/76 |
| 4,263,814 | 4/1981 | Takaoka | 92/71 |
| 4,285,640 | 8/1981 | Mokai | 417/269 |
| 4,381,178 | 4/1983 | Nakayama et al. | 417/269 |
| 4,408,962 | 10/1983 | Nakayama et al. | 417/269 |
| 4,410,279 | 10/1983 | Howden | 415/63 |
| 4,413,955 | 11/1983 | Kato et al. | 417/270 |
| 4,568,252 | 2/1986 | Hattori | 417/269 |
| 4,732,047 | 3/1988 | Kato | 417/269 |
| 4,790,727 | 12/1988 | Steel | 92/147 |
| 4,820,133 | 4/1989 | Steel et al. | 417/269 |

*Primary Examiner*—Leonard E. Smith

*Attorney, Agent, or Firm*—Donald J. Harrington; Frank G. McKenzie; Keith L. Zerschling

[57] ABSTRACT

A swashplate assembly for an air conditioning compressor comprising a die cast aluminum swashplate with shoe bearing surfaces formed during the die casting operation, a swashplate driveshaft with a knurled portion press fitted into an opening in the hub of the swashplate and an assembly of one-price, semi-spherical sintered metal shoes engageable with the swashplate bearing surfaces for translating rotary motion of the swashplate into reciprocating motion of the compressor pistons.

3 Claims, 7 Drawing Sheets

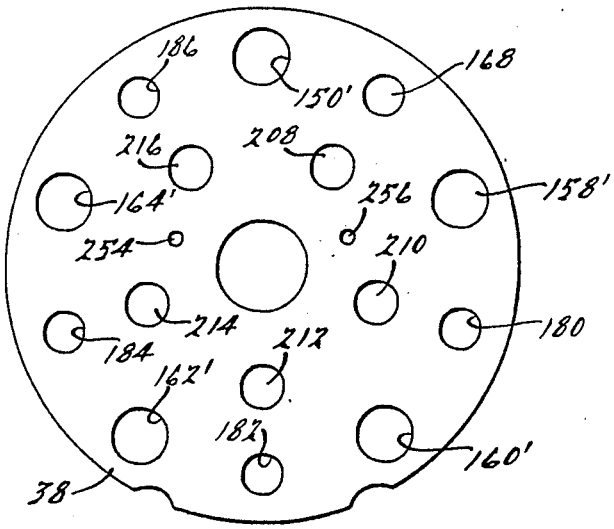
FIG. 7
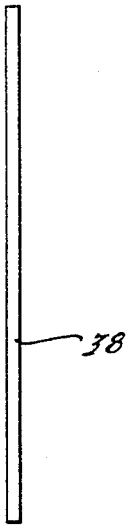
FIG. 8.
FIG. 9.
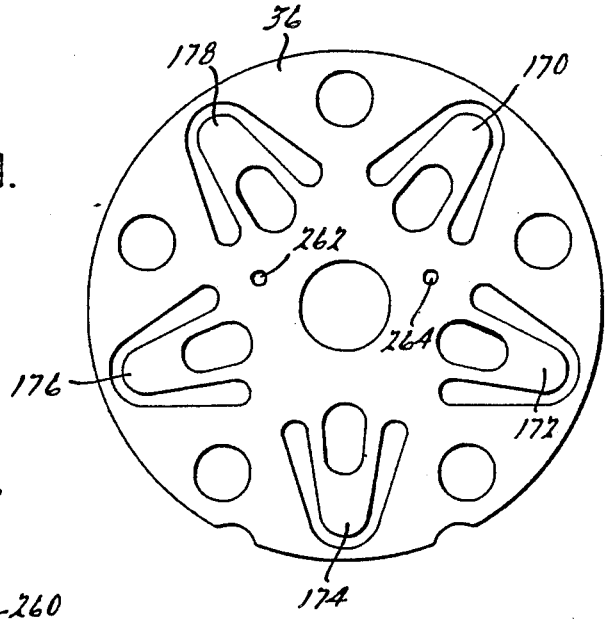
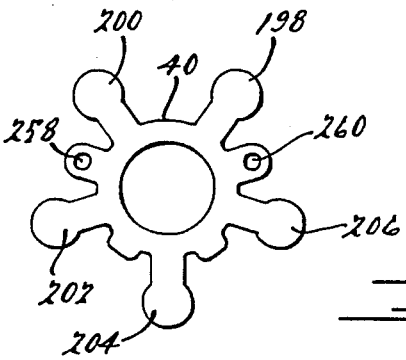
FIG. 10.

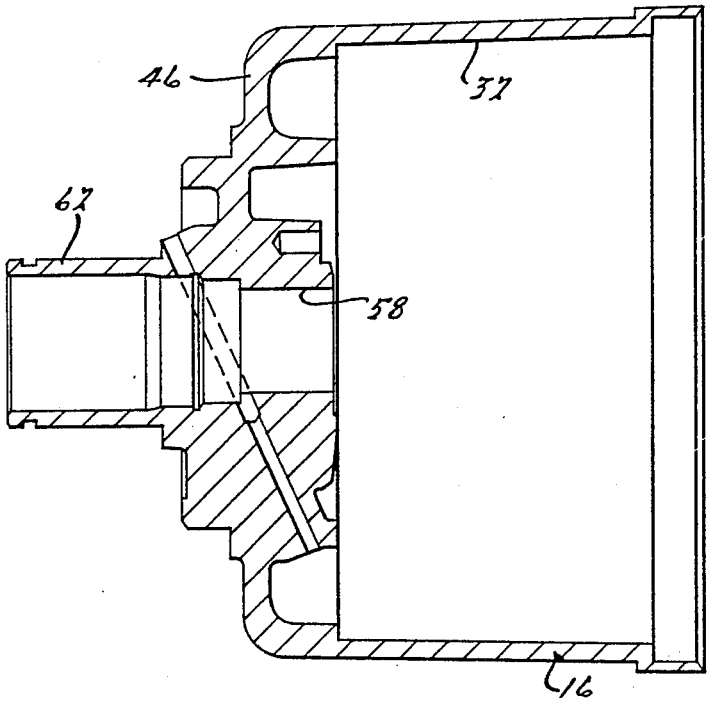
FIG. 14.
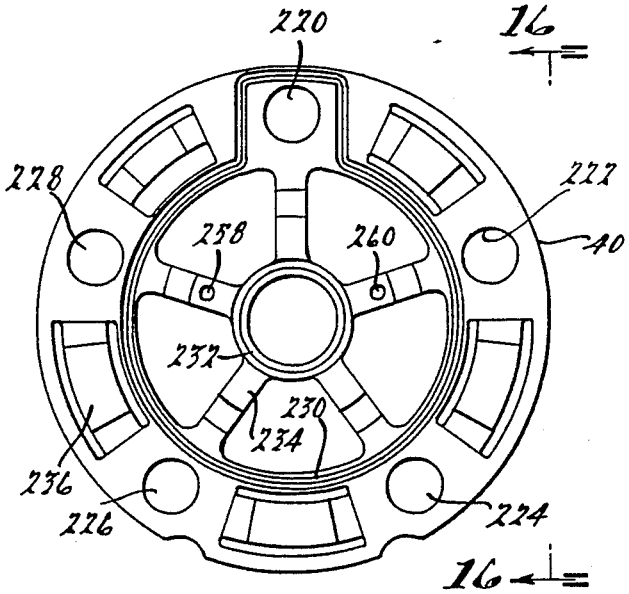
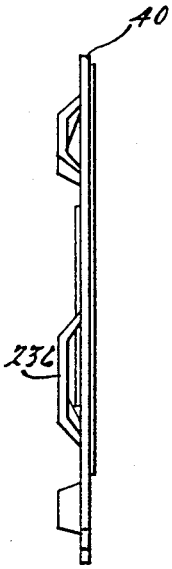
FIG. 15. FIG. 16.

SWASHPLATE AND SLIDING SHOE ASSEMBLY FOR AN AIR CONDITIONING COMPRESSOR

BACKGROUND OF THE INVENTION

Our invention comprises improvements in an automotive air conditioning compressor. It relates to the invention disclosed in application Ser. No. 101,110, filed by Duane F. Steele, entitled "Swashplate Compressor for Air Conditioning Systems", filed Sept. 25, 1987. That application is assigned to the assignee of our invention.

Prior art swashplate compressor designs may be seen by referring to U.S. Pat. Nos. 4,381,178; 4,413,955; 4,408,962 and 3,380,651. The designs shown in these prior art references include cylinder bodies in which axially arranged cylinders are machined in angularly spaced relationship about the axis of the compressor. Each cylinder receives a compressor piston, each piston comprising a pair of piston heads joined by a bridge to form an integral, double acting piston. The margin of a swashplate is received within a piston cavity located between each piston head adjacent the bridge. .A sliding swashplate shoe engages the swashplate and is held in place within the piston recess thereby providing a sliding drivable connection between the swashplate and each piston. As the swashplate rotates, the rotary motion of the swashplate is translated into reciprocating motion of the pistons.

The swashplate in the prior art constructions is formed of cast iron or powdered metal, the shoe engaging surfaces of which are machined following the forging operation. The swashplate is joined to a central driveshaft received through a central opening the hub of the swashplate. The swashplate and the driveshaft may be joined by a drive pin as shown in the '178 patent and in the '955 patent, or by a key and slot connection as shown in the '651 patent or by a friction force fit as shown in the '962 patent. The drive pin or the keyway driving connection introduces complexity into the compressor assembly and requires expensive machining operations. The machining operations, aside from the cost and the special machine tools that are required during manufacture, establish stress points which are potential causes of structural failure of the compressor during operation when the swashplate is subjected to high forces. In the prior art designs that employ a press fit between the shaft and the hub of the swashplate, such as in the design of the '962 patent, high stresses are developed as the shaft is pressed into the central opening of the swashplate hub. This requires a relatively large swashplate hub.

The machined surface of the swashplate, as seen in each of the prior art references mentioned above, is engaged by shoes. Each shoe has a recess in which is fitted a drive ball. In turn the ball is received in a recess in the adjacent piston. The ball is formed of high carbon steel, and the shoe is formed of a material having suitable bearing characteristics. Provision is made for establishing an oil film between the shoe and the adjacent surface of the swashplate engaged by the shoe.

Because of the machining operation that the swashplates of prior art designs require, it is necessary in those designs to provide a substantial relief near the hub of the swashplate. This reduces the axial dimension of the finished swashplate and reduces the strength of the swashplate. Because of the presence of the relief adjacent the hub of the swashplate, it is necessary to increase the axial effective width of the swashplate to maintain sufficient strength to withstand the substantial axial forces imposed on the swashplate by the pistons during operation. This avoids breakage of the swashplate as the driveshaft is inserted during manufacture into the central opening of the swashplate hub with a press fit as shown in the '962 patent.

BRIEF DESCRIPTION OF THE INVENTION

It is an object of our invention to overcome the shortcomings described above with respect to the prior art constructions. We have achieved this by using a die cast swashplate rather than a forged swashplate. The material used is die cast aluminum alloy 390, which is comprised of 16 to 18 percent silicon. The swashplate hub following the die cast operation, does not require grinding. Because no machining except for the end bearing surfaces of the swashplate hub diameters is required, as in the case of prior art designs, it is not necessary to provide deep reliefs or recesses adjacent the hub of the swashplate for purposes of tool clearance during the machining operation. The swashplate is capable of withstanding the stresses that are developed as the driveshaft is press fitted into a central opening formed in the hub of the swashplate.

All of the critical dimensions of the finished swashplate hub can be achieved during the die casting operation with the exception of the swashplate OD and shoe faces the end surfaces of the hub that are engaged by the thrust bearings and the central bore. A simple turning operation is required to machine these surfaces and to provide the necessary axial dimension of the hub.

Before the drive shaft is press fitted into the hub of the swashplate, the shaft is formed with the knurled portion. The knurl can be a standard knurl conforming to SAE standard specifications. The knurl extends only for a portion of the length of the swashplate hub. Because of the use of a knurl portion it is not necessary to provide a high degree of interference as the shaft is press fitted into the swashplate hub. This in turn eliminates the high forces that would otherwise be created during manufacture. It is thus possible to employ a die cast aluminum silicon alloy material, previously described, since high stresses are avoided during the manufacture of the swashplate and shaft assembly. This stress avoidance is in addition to the stress avoidance, described above, that is achieved by the elimination of a deep tooling recess adjacent the hub of the swashplate which would be required if a finished machining operation were to be needed.

Our improved design eliminates also the necessity for using a shoe and ball subassembly. We have provided a sliding driving connection between the swashplate and each of the pistons by means of a generally semicircular powered metal cast shoe having a semispherical bearing surface received in a semispherical pocket formed in the piston. One surface of the powered metal shoe forms a bearing surface that slidably engages the sliding surface of the swashplate. No finish machining of the shoes (i.e., metal cutting) is required except for grinding of the shoe face because it is an alloy of iron having possible to manufacture the shoes using a powered metal process in which the material is approximately 90 percent iron, 2 percent nickel and approximately 5 percent copper. The bearing surface of the shoes can be held to approximately 26 microns using the powered metal process and the porosity of the shoe itself is conducive to the development of a lubricating oil film. This feature of our invention improves both the performance and substantially reduces the cost because of the simplicity of its manufacture and the reduction in the number of parts.

The improvements of our design make it possible to provide a swashplate assembly that has better detail because of the die cast operation employed in its manufacture. The die cast aluminum alloy and the powered metal shoes provide better wear surfaces than the forgings of the prior art designs, and the reduction in the number of machining operations substantially reduces the cost. The shallow relief that it required because of the die cast operation, in contrast to a forging operation, improves the durability of the assembly.

BRIEF DESCRIPTION OF THE FIGURES OF THE DRAWINGS

FIG. 7 is a plan view of the front of the valve plate used in the assembly.

FIG. 8 is an edge or end view of the plate of FIG. 7 as seen from the plane of section 10—10 of FIG. 7.

FIG. 9 is a plan view of an inlet valve reed positioned at each axial end of the cylinder blocks.

FIG. 10 is a plan view of the outlet or discharge valve reed located at each axial end of the cylinder blocks.

FIG. 14 is a sectional view taken along the plane of section line 14—14 of FIG. 13.

FIG. 15 is a plan view of the gasket for the discharge reed valve and valve plate at each end of the cylinder blocks.

FIG. 16 is an edge or end view of the gasket as seen from the plane of section line 16—16 of FIG. 15.

PARTICULAR DESCRIPTION OF THE INVENTION

Figure 1:
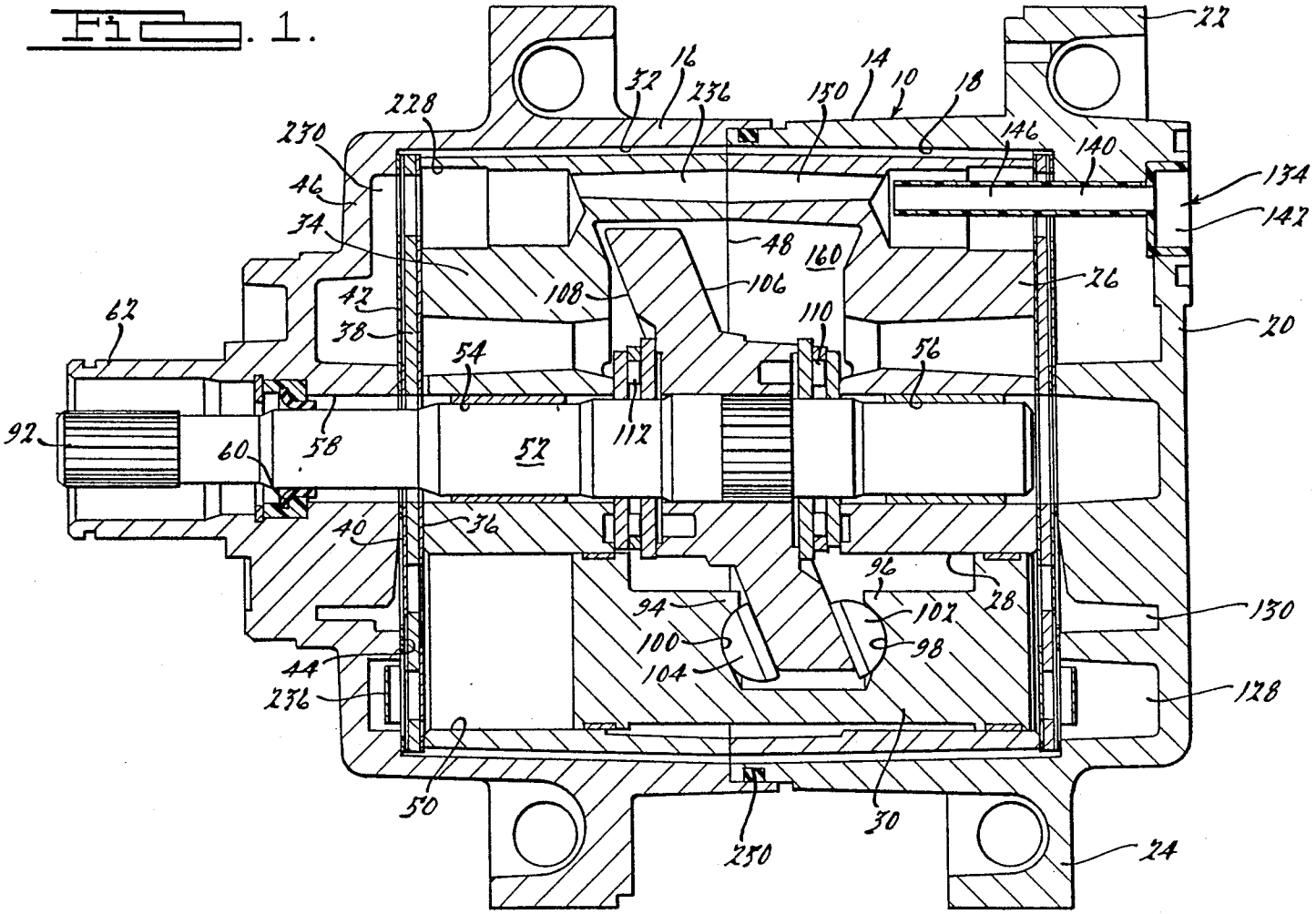
FIG. 1 is a cross-sectional assembly view of a compressor assembly embodying the features of our design.

In FIG. 1 reference character 10 designates generally a cast housing for an air conditioning compressor.

Housing 10 includes a rear housing part 14 and a front housing part 16, each of which is formed of die cast aluminum alloy. Housing part 14 has a cylindrical interior 18 and an integral end wall 20 that forms a part of the die casting. Mounting bosses 22 and 24 are formed as part of the die casting, and mounting bolts are received in bolt openings formed in the bosses 22 and 24.

A die cast aluminum cylinder body 26, in which is formed a plurality of cylinder openings, is itself of cylindrical shape and is fitted within the opening 18 with a very small clearance between the inner diameter of the cylindrical opening 26 of the housing 14 and the outer diameter of the cylinder body 26.

One of the cylinder openings in the cylinder body 26 is shown at 28. A compressor piston 30 is slidably received in the cylinder opening 28.

The front compressor head comprises the companion housing part 16. Like the housing part 14, housing part 16 has a circular central opening as seen at 32. A cylinder body 34, which itself is of cylindrical shape, is received in the cylindrical opening 32 with a minimum clearance between its outer diameter and the inside diameter of the cylindrical opening 32.

An inlet valve plate in the form of a circular spring steel disc is identified by reference numeral 36. That disc will be described with reference to FIG. 9. Adjacent the disc 36 is a front valve plate 38, which has formed in it valve openings that register with reed valve elements of the inlet valve disc 36. This front valve plate 38 will be described with reference to FIG. 9.

A front discharge valve plate 40, which will be described with reference to FIG. 10, is located directly adjacent valve plate 38. It is formed with reed valve elements that register with valve openings formed in valve plate 38.

A front gasket plate 42 is disposed between the front discharge valve plate 40 and the end surface 44 of the opening 32 formed in the housing part 16. Surface 44 is a machined surface on the inner face of the end wall 46 of the housing part 16.

As seen in FIG. 1, the cylinder block 30 is assembled in abuting relationship with respect to the cylinder block 34, the abuting surfaces being identified by common reference numeral 48. As seen in FIG. 1, cylinder opening 28 is aligned with cylinder opening 50 in cylinder block 34 thus forming a common cylinder for the reciprocating piston 30.

A swashplate shaft 52 is journalled by bushing 54 in cylinder block 34 and by bushing 56 in cylinder block 26. Shaft 52 extends through end plate opening 58 in the end plate 46. A fluid seal 60 seals the interior of the housing as the shaft 52 rotates in shaft opening 58.

A stationary sleeve shaft extension 62 is formed on the end plate 46 and provides a support for an electromagnetic clutch, now shown.

Figure 6:
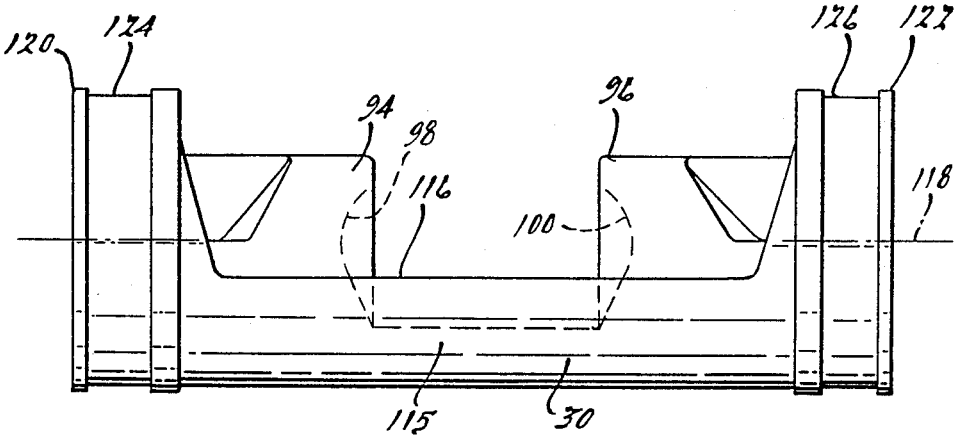
FIG. 6 is a side view of a piston adapted to be received in a cylinder of the cylinder block of FIGS. 2 and 3.

As seen in FIG. 1 and in FIG. 6, the piston comprises two juxtaposed bosses 94 and 96, which are machined to provide semi-spherical pocket recesses 98 and 100 for swashplate shoes 102 and 104, respectively. The shoes are formed of sintered powder metal, which may comprise about 90% iron, 2% nickel and 5% copper, although higher percentages of iron (e.g., 97%) together with lesser amounts of copper (e.g., 0.5%) and nickel also would be feasible. The shoes are provided with a flat bearing surface that slidably engage surfaces 106 and 108, respectively, on the swashplate and shaft assembly shown in FIG. 1 and in FIG. 4. The bearing surface is formed in the sintering process. Finish machining is not required except for grinding of the face. A smoothness of 26 microns or less can be achieved in the sintering operation.

Figure 4:
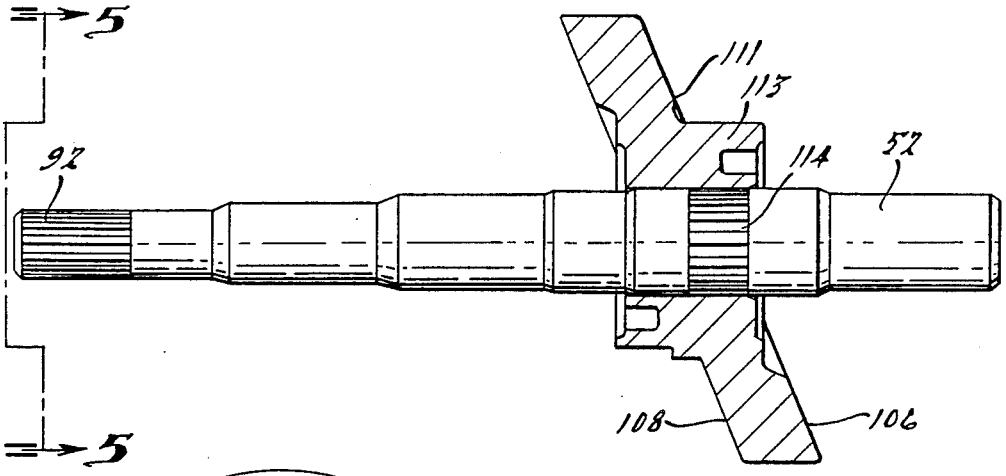
FIG. 4 is a side elevation view of a swashplate and shaft assembly which form a part of the assembly of FIG. 1.
Figure 5:
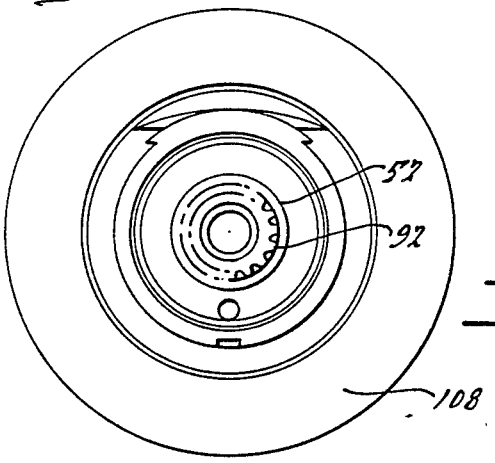
FIG. 5 is an end view of the structure of FIG. 4 as seen from the plane of section line 5—5 of FIG. 4.

The die cast aluminum-silicon alloy swashplate is disposed, as seen best in FIG. 4, at an angle relative to the axis of the shaft. The swashplate itself, which is designated by reference character 111, includes a hub 113 that is press fitted on the shaft 52 and that is locked in place by standard SAE serrations 114 formed on the shaft 52 prior to the assembly of the swashplate 111 on the shaft by the press fitting operation. The serrations extend for only a part of the depth of the swashplate hub. As the shaft 52 rotates, the swashplate 106, due to the sliding engagement with the shoes 102 and 104, causes the piston 30 to reciprocate in the cylinder defined by cylindrical openings 28 and 50 in the cylinder blocks 26 and 34, respectively. Thrust forces on the swashplate are accommodated by the radial needle bearing assemblies 110 and 112, which respectively engage the cylinder blocks 26 and 34 whereby the thrust on the swashplate hub is absorbed by the cylinder blocks.

The shoes 102 and 104, which are formed of sintered metal, have flat bearing surfaces that are provide enough to carry a lubricating oil film thus establishing a nonabrasive sliding bearing relationship with respect to the swashplate surfaces 106 and 108 as the pistons are reciprocated.

The swashplate is provided with very shallow recesses or reliefs on either side of the swashplate. This is in contrast to the deep reliefs that would be required if the swashplate were to be forged, as in prior art designs.

As best seen in FIG. 6, the piston 30 is formed of a unitary die casting. It includes a bridge portion 115 of reduced depth with respect to the diameter of the ends of the piston. The bridge portion is formed during the die casting operation with an upper surface 116 that is situated below the centerline 118 of the piston. This permits sufficient clearance for the outer margin of the swashplate 111 thereby preventing interference during operation of the compressor. This die casting operation eliminates complex machining operations that are common to reciprocating pistons of swashplate compressors of the kind illustrated in the prior art disclosures mentioned in the specification.

As seen in FIG. 6, the piston is a double acting piston that is provided with piston ends 120 and 122 of equal diameter. Each end 120 and 122 has a piston seal groove 124 and 126 which receives a piston seal ring.

Figure 11:
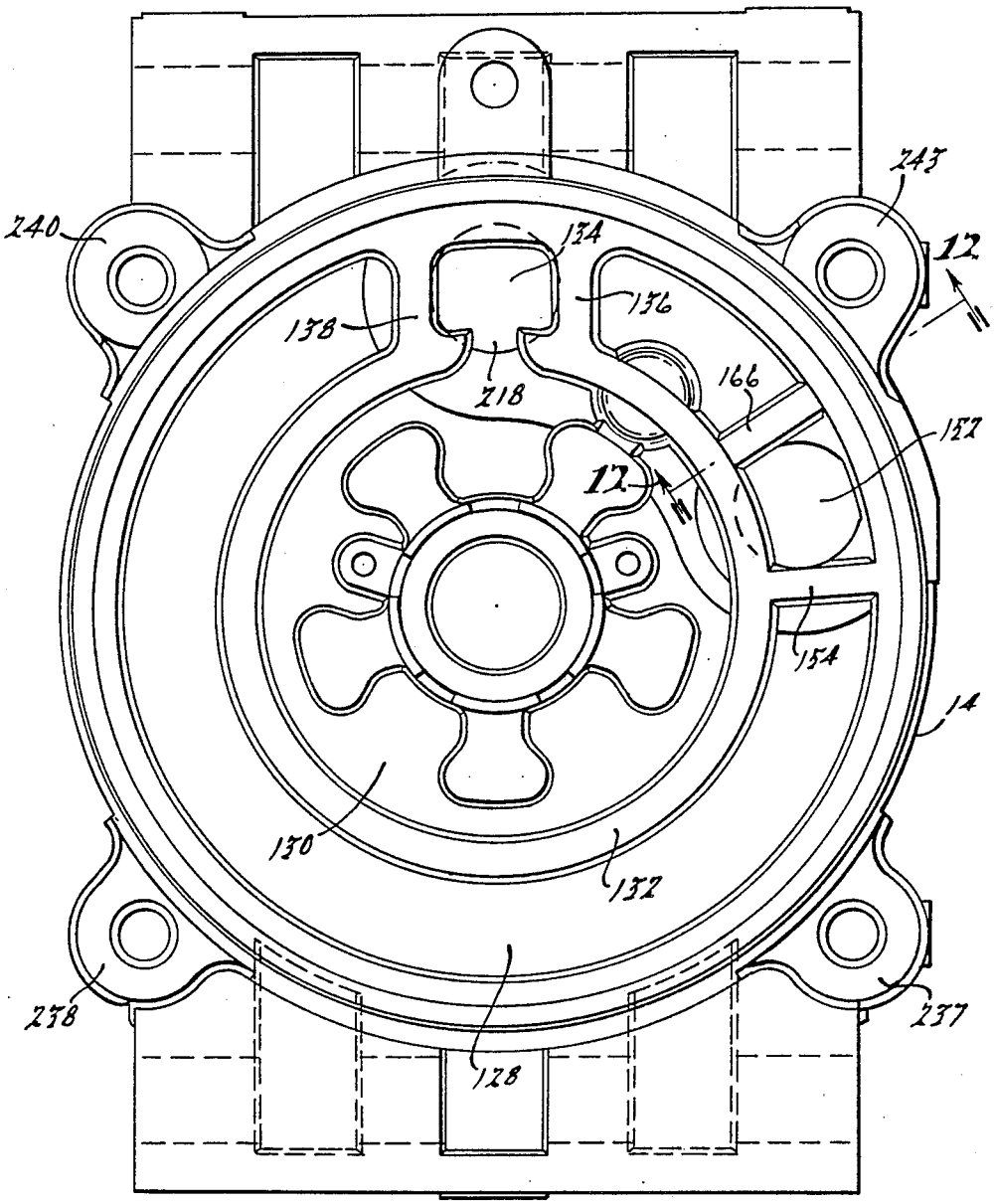
FIG. 11 is an end view of the rear casting head or housing for the assembly. It shows the interior porting and passage arrangement at the end wall of the opening in the casting head.
Figure 12:
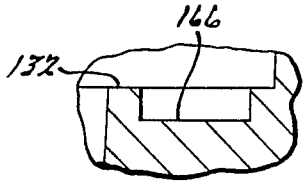
FIG. 12 is a sectional view taken along the plane of section line 12—12 of FIG. 11.

The rear housing part wall 20 of the housing part 14 has inlet and outlet pressure cavities that are formed in it during the die casting operation. The low pressure inlet cavity shown at 128 encircles the shaft 52 as best seen at numeral 128. It is separated from the high pressure cavity 130 by a cylindrical baffle 132. The outlet port, which is a high pressure discharge port, is shown in FIGS. 1 and 11 by reference numeral 134. The upper extremity of the cylinderical baffle wall 132, as seen in FIG. 12, registers with and forms a continuation of separater walls 136 and 138 which isolate the outlet passage from the inlet passage 128. Located in the outlet port 134 is a pulsation damper tube or muffler, preferably made of plastic material. This is indicated in FIG. 1 by reference numeral 140. It includes a cylindrical end piece 142 received in the discharge port 134. It includes also a reduced diameter extension 146 that is received in the high pressure cavity 130. The left hand end of the extension 146, as seen in FIG. 1, is received in discharge passage 150 of the rear cylinder block 26. This is seen best by referring to FIG. 2.

When high pressure discharge gas is distributed to the discharge port 150 of the cylinder block 26, it passes into the discharge passage 130 formed in the die cast end plate of the housing part 14. But before the gas be transferred to the discharge opening 134 it must reverse in its directional flow toward the left hand opening of the extension 146 of the damper 140. The flow passage in the extension 146 is of less area than the flow area of the opening 134. This circuituous flow path for the discharge gas results in a dampening of undesirable pressure pulsations in the delivery of the refrigerant.

In FIG. 11 the inlet opening for the refrigerant is shown at 152. It should be noted in FIG. 11 that communication between opening 152 and the arcuate region of the inlet passage 128 is interrupted by a bridge 154. The plane of the inner surface of the bridge 154 is common to the plane of the inner surface of the baffle wall 132. Gases that enter the port 152, therefore, pass directly through openings 156 in reed valve plate 36 as see in FIG. 9.

Figure 2:
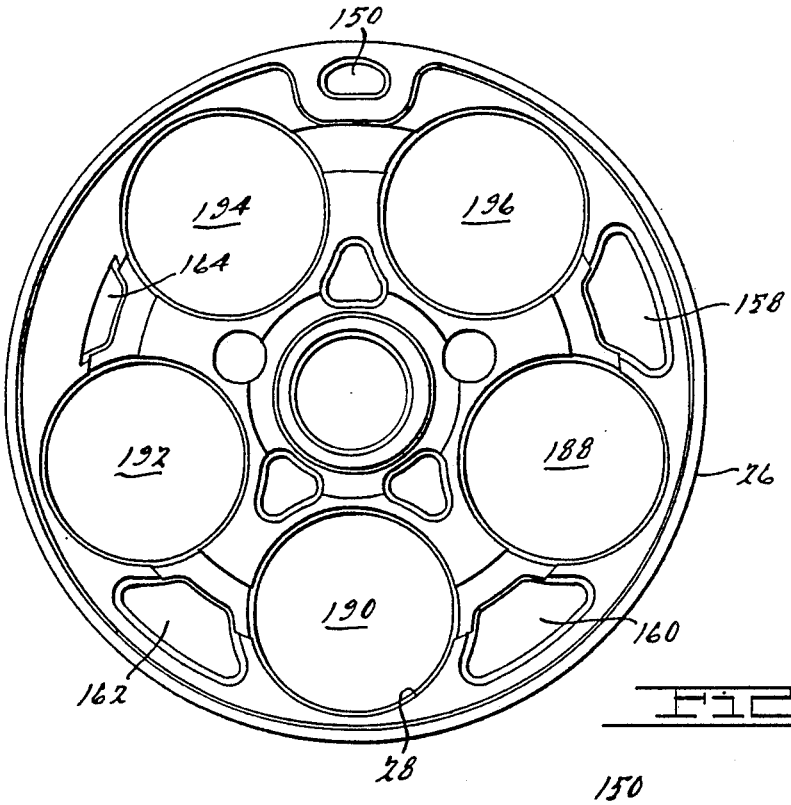
FIG. 2 is an end view of one of the two cylinder blocks that form a part of the assembly of FIG. 1.

The low pressure refrigerant then passes through opening 158 of the rear valve plate 38 shown in FIG. 7. The refrigerant gas then is passed through openings 158 that are cast in the cylinder body 26 as seen in FIG. 2.

The gases then accumulate in the region 160. From there the refrigerant gases pass into each of the other cast low pressure passages 162 and 164 as seen in FIG. 2. The right hand end of each of these cast passages seen in FIG. 2 communicates with the low pressure passage 128 that is cast in the end wall 20 of the housing part 14, as previously described.

As seen in FIG. 11 there is a second bridge 166 which bridges the baffle wall 132 with the outer housing wall. The inner surface of this bridge 166 is lower relative to the base of the inlet passage 128 than the machined surface of the bridge 154. Thus direct communication is permitted between opening 152 and opening 168 formed in the valve plate of FIG. 7.

The valve reed disc of FIG. 9 includes a flexible cantilever valve part 170 which registers with the opening 168 and permits one-way flow through the opening 168 when the piston for the associated cylinder adjacent to it undertakes its intake stroke. The bridge 166 acts as a partial baffle that prevents transfer of a so-called slug of refrigerant in liquid form into the adjacent cylinder and permits relative equal distribution of refrigerant to each of the other cylinders. It does this by assuring that most of the refrigerant, perhaps 80 percent of the inlet flow, is transferred to the cavity 160 and distributed from there through the internal flow intake passages 162 and 164 and 158 from which it is transferred to the cast intake passage 128 formed in the end plate 20 of the housing portion 14.

As seen in FIG. 11, there are multiple cantilever valve elements at 172, 174, 176 and 178 as well as at 170. These valve elements or reeds register with valve plate openings 180, 182, 184, and 186 as well as with opening 158. The cylinder block 26, as seen in FIG. 2, has 5 cylinder openings which accommodate 5 compressor pistons and each cylinder is served by a separate one of the valve reeds shown in FIG. 9. As each piston 130 is stroked in a left hand direction as seen in FIG. 1, refrigerant is drawn through the valve plate opening and past its associated valve reed. Refrigerant is then drawn from the opening 128 in the case of cylinders 188, 190, 192 and 194 which are identified in FIG. 2. In the case of cylinder 196 shown in FIG. 2, refrigerant is drawn directly from the opening 152 across the bridge 168.

The discharge reed assembly of FIG. 10 includes a plurality of reed valve elements separately identified by reference characters 198, 200, 202, 204, and 206. Each of these valve elements registers with high pressure discharge openings 208, 210, 212, 214, and 216, as seen in FIG. 7. Each of these openings serves as a discharge port for the high pressure refrigerant as the pistons for the respective cylinders are stroked in a right hand direction, as seen in FIG. 1. The discharge reeds shown in FIG. 10 permit one-way flow of high pressure gases into the discharge flow path 130 previously described with reference to FIG. 11. A baffle wall 132 is separated at 218 to permit communication between passage 130 and the discharge passage 134.

Figure 13:
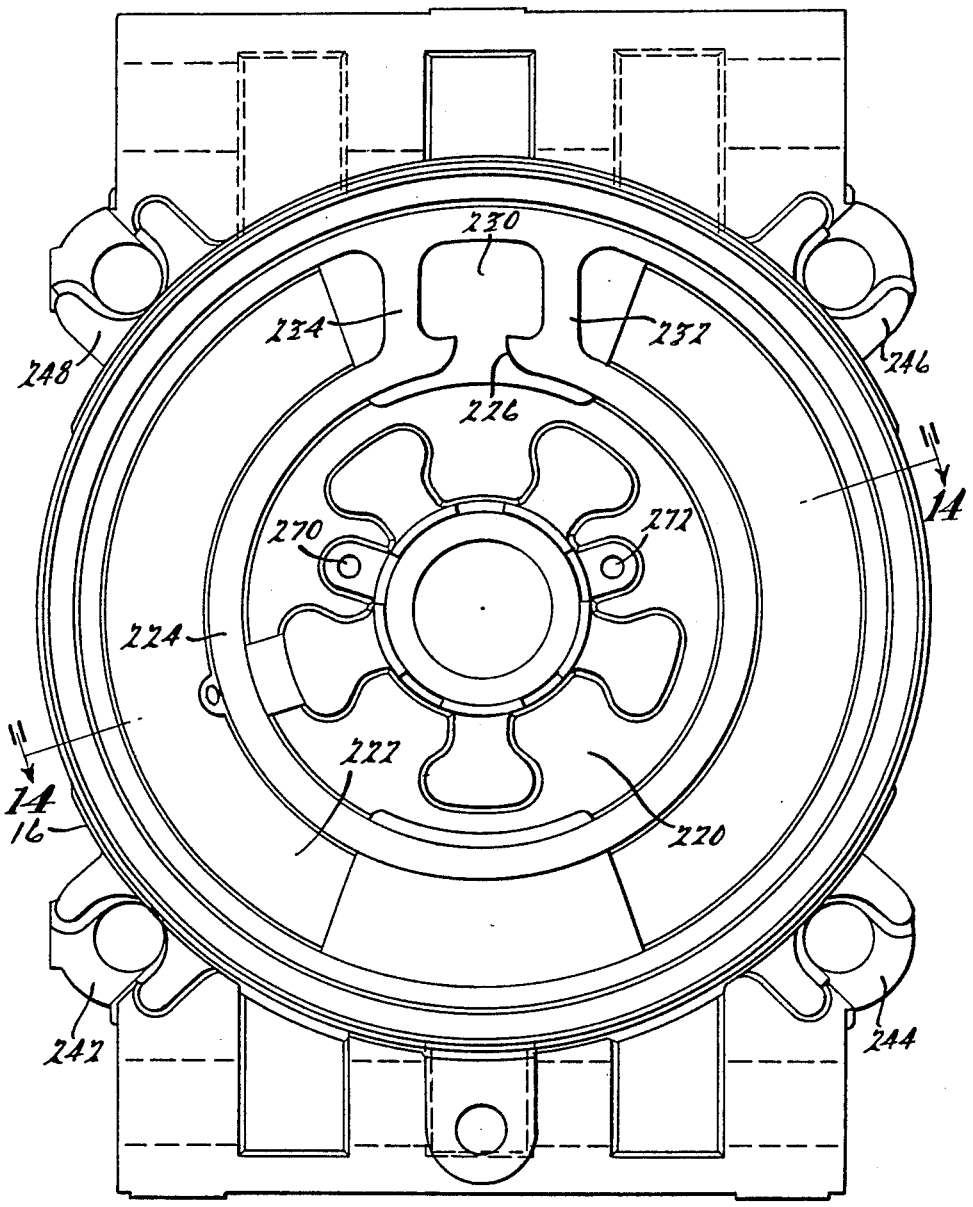
FIG. 13 is an end view of the front casting head of the housing showing the interior of the end wall of the front head together with the porting and passage structure.

The cylinder block 34 is identical and interchangeable with cylinder block 26. The valve plate, the inlet reeds and the discharge reeds described with reference to the rear housing part 14 are identical to those that function with respect to the front housing part 16. Like the rear housing part 14, the front housing part 16 shown in FIG. 13 is provided with cast high pressure and low pressure passages. The high pressure passage shown at 220 corresponds to high pressure passage 130 of the rear housing part. Low pressure passage 222 of FIG. 13 corresponds to low pressure passage 128 of the rear housing part.

A baffle wall 224, which corresponds to the baffle wall 132 of the rear housing part 14, separates passages 220 and 222. The wall 224 is discontinuous as shown at 226 to provide communication between passage 220 and the outlet opening 228 as seen in FIG. 1. The region 230, seen in FIG. 1 and in FIG. 13, which is the high pressure region, is separated from the low pressure inlet passage 222 by bridge portions 232 and 234 of the baffle wall 224.

Fluid that is discharged by the pumping pistons passes from discharge passage 220 and into the region 230, whereupon it passes through internal crossover passage 236 seen only in FIG. 1. This passage corresponds to passage 150 that was described with reference to the rear cylinder block of FIG. 2. Passage 150 and passage 236 register at their juncture to form a continuous passage that communicates with the discharge opening 142 seen in FIG. 1. This internal crossover passage eliminates the need for providing a separate crossover tube as in some prior art arrangements, and it may be formed during the die casting operation with minimal finish machining operations being required.

I have shown in FIG. 15 a gasket or seal plate that is interposed between the valve plate and the inner machined surface of the front and rear housing parts. The gasket of FIG. 13, which was described with reference to FIG. 1 and identified by reference numeral 140, includes an opening 220 with a high pressure opening 186 in the valve plate of FIG. 7. It includes also openings 222, 224, 226, and 228 which register with cast end openings in the front cylinder block, which in turn correspond to the cast end openings previously described with reference to the cylinder block 26 shown in FIG. 2. These respectively are shown at 150, 158, 160, 162 and 164. The corresponding openings in the valve plate 28 of FIG. 7 are shown in FIG. 7 at 150', 158', 16', 162' and 164'.

FIG. 15 shows at 230 an embossment which encircles the axis of the shaft 52 and which envelopes the opening 220. The embossment forms a continuous ridge which registers with valve plate locations opposite the machined inner surface of the baffle wall 225, as shown in FIG. 13. It registers also with the machined surface of the bridge portions 232 and 234 of the baffle wall 225. Thus the embossment forms an effective seal that isolates the high pressure cast passage 220 from the low pressure cast passage 222. The gasket or seal of FIG. 15 includes also an inner embossment ring 232 which prevents passage of high pressure refrigerant from the high pressure discharge port for the cylinders from the region of the bearing 54 and the shaft opening 58.

A similar gasket or seal plate is used to seal the high pressure and low pressure passages in the end plate 20 of the rear housing part 14.

The valve plate for the front cylinder block is identical to the valve plate for the rear cylinder block. Similarly, the inlet valve reeds and the discharge valve reeds for the front and rear cylinder blocks are identical, one with respect to the other. This interchangeability, as well as the interchangeability of the cylinder blocks themselves, simplifies both the design and the manufacture and assembly of the components, thus making it possible to achieve reduced manufacturing costs and improved reliability during operation following assembly.

Radial arms, one of which is shown at 234 in FIG. 15, support the hub of the gasket on which the embossment 232 is formed.

Near the radially outer margin of the gasket of FIG. 15 are straps 236 which provide rigidity to the disc but which are displaced out of the plane of the gasket thereby permitting free flow of refrigerant gas through the valve plate openings and past the inlet valve reeds. The relative position of the straps 236 with respect to the plane of the gasket can be seen by referring to FIG. 1 where the gasket is shown in cross section.

As seen in FIG. 11 the rear housing part 14 has four external bosses 237, 238, 240, and 243. Similarly, the front housing part 16 has bosses 244, 242, 248 and 246, which register with the bosses 237, 238, 240, and 243 of the front housing part 16. Each of these bosses has a bolt opening to permit entry of a clamping bolt. When the bolts are tightened following assembly of the components, the cylinder blocks are brought into registry, one with respect to the other, and a predetermined load is applied to the gasket. Effective seals thus are established. The left hand margin of the housing part 14 is received within the right hand margin of the housing part 16, as seen in FIG. 1, and an "O" ring seal 250, which is received in an "O" ring groove in the housing part 14, establishes a fluid tight seal between the mating parts.

The previously mentioned shoes that engage the surfaces 106 and 108 of the swashplate are formed of powdered metal that may be heat treated to a hardness of over 40 Rockwell C. It is possible, therefore, to eliminate the necessity for using a separate shoe on the movable slipper element as in prior art designs such as those shown in the prior art references mentioned in the preceding portion of this specification. The shoes themselves may or may not be tumbled after they are finished. In addition to the interchangeability of the parts—for example, the inlet valve disc, the discharge valve disc and the valve plate—preassembly of the valve plate with the gasket and the two reed valve discs can be achieved by locater pins which are received in pin openings formed in valve plate 38 illustrated in FIG. 7. These pins are received with a force fit in pin openings 254 and 256 as seen in FIG. 7. Corresponding openings 258 and 260 are formed in the discharge valve of FIG. 10, and these register with the locater pins. Similarly, locater pin openings 258 and 260 are formed in the gasket as formed in FIG. 15, and these also register with the locater pins.

Figure 3:
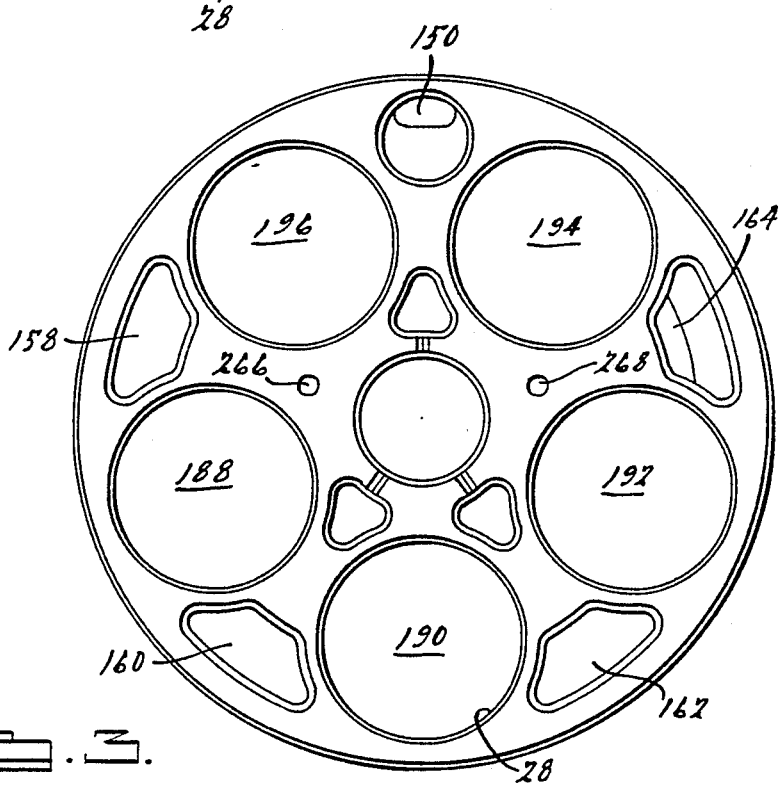
FIG. 3 is an end view showing the opposite end of the cylinder block of FIG. 2.

On the opposite side of the valve plate pin openings 262 and 264, as seen in FIG. 9, register with the valve pins. Thus the valve plate, the inlet valve disc, the discharge valve disc and the gasket can be preassembled to simplify the manufacturing operation. After this preassembly procedure the subassembly is inserted into registering pin locater openings 266 and 268, shown in FIG. 3 for the rear housing part. Corresponding pin openings 270 and 272 for the front housing part can be seen in FIG. 13. These locater pins establish proper angular registery of the assembled parts, one with respect to the other. No fasteners are required and the manufacturing cost and assembly cost and improved reliability by a simplified assembly is achieved.

Manufacturing operations are simplified further by the piston construction as explained previously. The piston construction has a bridge area that does not require finished machining. The bridge area is formed during the die casting operation and it permits the swashplate outside diameter at maximum displacement to extend beyond the bosses for the slippers. There is no need for machining a relief area in the bridge surface as in the prior art constructions, examples of which are shown in the references described in this specification. It is permissible with this design for the swashplate to engage the bridge surface with a running engagement on the midpoint surfaces of the bridge.

The improved design further provides improved reliability and simplified manufacturing operations by reason of the die casting process for forming the swashplate itself. It is normal practice in the design of a swashplate compressor to use a cast forge process or by using a forging process without casting. The depth between the face of the shoe and the relief in the hub of the swashplate is sufficiently shallow in our design to assure sufficient strength. The presence of the refrigerant in the region of the swashplate provides sufficient lubrication because sufficient lubricating oil is present. The refrigerant gas permits an oil film to be developed continuously over the surfaces engaged by the shoes.

The bearings 54 and 56 for the shaft 52 are steel backed sleeve bearings which can be assembled with no further machining being required after installation. These are located, as seen in FIG. 1, adjacent radial needle bearings 112 and 110 respectively. The cage for the radial rollers of the bearings 112 and 110 rotate in the usual fashion between two thrust washer rings. This establishes a centrifugal pumping action which draws lubricant and refrigerant from the inboard ends of the sleeve bearings. A pressure differential exists between the swashplate chamber and the inlet annulus that is cast in each of the end plates for the housing parts. The existence of this pressure differential creates a pressure differential across the bearings themselves and this is aided by the centrifugal action of the rotating cages of the radial needle bearings, which act as thrust bearings. Thus the cages of the radial needle bearings, which act as thrust bearings, and the journal bearings are lubricated thereby further improving the reliability of the compressor.

Having described a preferred embodiment of my invention, what we claim and desire to secure by U.S. Letters Patents is:

1. In a air conditioning compressor;

a swashplate assembly comprising a die cast aluminum alloy swashplate with bearing surfaces disposed in a plane angularly oriented with respect to the swashplate axis, a swashplate hub, a hub opening formed centrally in the hub and thrust bearing surfaces on each axial side of said hub;

a driveshaft, a knurled portion on said driveshaft, said driveshaft being received in said hub opening with a force fit, the degree of dimension interference that establishes said force fit being reduced due to the presence of said knurled portion, whereby a driving connection between said swashplate and said driveshaft is established with minimal stress on said swashplate;

said swashplate assembly including multiple, generally semispherical, unitary shoes, said shoes being formed of sintered powdered metal, each shoe having a bearing surface engageable with said bearing surfaces on said swashplate;

a cylinder body, cylinders disposed axially in said cylinder body surrounding the axis of said driveshaft;

double acting pistons in said cylinder, a partial spherical recess in said cylinders on either side of said swashplate;

said shoes being received in said piston recesses, the powdered metal shoes being formed of a bearing alloy of iron with iron being the major ingredient.

2. The combination as set forth in claim 1 wherein said driveshaft is formed of steel and said knurled portion extends for substantially less than the full length of said hub opening.

3. The combination as set forth in claim 1 wherein each side of said swashplate is formed with a bearing surface and said shoes engage each bearing surface at directly opposite locations whereby each pair of said shoes is adapted to establish a driving connection between one of said pistons and said swashplate.

* * * * *

UNITED STATES PATENT AND TRADEMARK OFFICE

CERTIFICATE OF CORRECTION

PATENT NO. : 4,950,132

DATED : August 21, 1990

INVENTOR(S) : Chester J. Brian, Jr., et al.

It is certified that error appears in the above-identified patent and that said Letters Patent is hereby corrected as shown below:

Column 1, line 23, delete the second period (.) before "A".
Column 2, lilne 15, äfter "hub" insert a comma (,).

Column 5, line 17, delete "provide" and substitute --porous--.

Signed and Sealed this

Twelfth Day of January, 1993

*Attest:*

DOUGLAS B. COMER

*Attesting Officer*

*Acting Commissioner of Patents and Trademarks*